US005329639A

United States Patent [19]

Aoki

[11] Patent Number: 5,329,639

[45] Date of Patent: Jul. 19, 1994

[54] ICE HOCKEY GLOVE WITH REMOVABLE PALM

[75] Inventor: Akio Aoki, Osaka, Japan

[73] Assignee: Trion Corporation, Osaka, Japan

[21] Appl. No.: 993,600

[22] Filed: Dec. 21, 1992

[51] Int. Cl.[5] ..... A41D 19/00

[52] U.S. Cl. ..... 2/161.1; 2/16

[58] Field of Search ..... 2/16, 18, 19, 20, 159, 2/160, 161 R, 161 A, 162, 169, 158, 161.1

[56] References Cited

U.S. PATENT DOCUMENTS

| | | | |
|---|---|---|---|
| 550,949 | 12/1895 | Decker | 2/19 |
| 944,949 | 12/1909 | Cormey | 2/158 |
| 1,612,055 | 12/1926 | Rice | 2/160 |
| 3,605,117 | 9/1971 | Latina | 2/16 |
| 4,027,339 | 6/1977 | Brucker | 2/16 |
| 4,667,343 | 5/1987 | Bettis | 2/161 A |
| 4,704,743 | 11/1987 | Thornell et al. | 2/159 |
| 4,779,289 | 10/1988 | Prouty | 2/161 R |
| 5,033,119 | 7/1991 | Wiggins | 2/162 |
| 5,218,718 | 6/1993 | Chih | 2/16 |

FOREIGN PATENT DOCUMENTS

| | | | |
|---|---|---|---|
| 3151852 | 7/1983 | Fed. Rep. of Germany | 2/158 |

*Primary Examiner*—Clifford D. Crowder
*Assistant Examiner*—Michael A. Neas
*Attorney, Agent, or Firm*—Webb Ziesenheim Bruening Logsdon Orkin & Hanson

[57] ABSTRACT

The present invention provides a protective glove for ice hockey wherein the palm area can be quickly removed and replaced. The glove is formed of a back member covering the back of the user's hand and having the exterior surface of the back member covered with padding appropriate to protect the user's hand. A removable front portion is attached to the back member by a zipper which extends around the peripheral edges of the glove. An overlapping wrist closure mechanism with the overlapping flaps provided with Velcro® hook and loop type fastening devices assists in securing the ice hockey glove to the user.

14 Claims, 2 Drawing Sheets

ICE HOCKEY GLOVE WITH REMOVABLE PALM

BACKGROUND OF THE INVENTION

1. Field of the Invention

The present invention relates to a protective glove for ice hockey, specifically the invention relates to an ice hockey glove in which the palm area for holding the stick can be removed and replaced quickly and easily.

2. Prior Art

During ice hockey when a player uses a pair of gloves for a prolonged period, the palm area of the glove collects moisture from melted ice as well as from player perspiration. This collection of moisture reduces the sensitivity of the player's hand and the gloves need to be replaced. Consequently, it is typical for an ice hockey player to keep a plurality of gloves in order to maintain sufficient sensitivity within the player's hands. The players require this sensitivity to maintain skillful stick-handling ability which is essential in the sport of ice hockey.

In a hockey glove, the portion on the back of the glove is usually protected with padding and is less susceptible to damage and wear during conventional use. The front or palm portion of the glove exhibits wear to a much greater extent during use due to constant engagement with the hockey stick. Consequently, the palm area of hockey gloves is more likely to abrade and tear than the back of the glove. Heretofore, the palm area of a glove is generally the determining factor of the durability and life of the hockey glove.

U.S. Pat. No. 3,605,117 to Latina discloses an ice hockey glove which addresses some of these issues. The hockey glove of the Latina patent discloses a hand receiver portion or inner glove which is attached to a padded back portion at the ends of the finger stalls and the outer sides of the palm area, but otherwise remains detached from the inner glove. The inner glove is coupled to the padding through lacing. Consequently, when the face of the inner glove wears out, the lacings need to be withdrawn and a new inner glove installed, thereby allowing reuse of the back padding. The Latina patent suffers from the disadvantage that it does not allow for quick replacement of the inner glove. Replacing the entire inner glove of the Latina patent is a time-consuming procedure requiring the user to remove and replace all of the laces in the hockey glove. Additionally, the replacement of the entire inner glove portion in the Latina patent is not the most efficient procedure since only the palm portion of the glove is generally damaged. Additionally, the attachment of the back padding to the glove at only distinct points may lead to the padding failing to conform to the configuration of the user's hand and possibly failing to adequately protect the user in certain positions.

The object of the present invention is to overcome the aforementioned drawbacks of the prior art. Additionally, the object of the present invention is to provide an ice hockey glove with a quick, efficient and economical palm area replacement. Another object of the present invention is to provide an efficient wrist closure mechanism for securing the glove to the user's hand and wrist.

SUMMARY OF THE INVENTION

The present invention provides a hockey glove with an easily replaceable palm area. The hockey glove includes a back member having a body portion, a thumb portion and a plurality of finger portions. Padding members are permanently attached to the exterior side of the back member substantially covering the back member, thereby protecting the user's hand A plurality of interchangeable front members are provided with each front member including a palm portion, a thumb portion and a plurality of finger portions. The number of finger portions of the front member correspond to the number of finger portions in a corresponding back member. Attaching means removably couple one of the front members to the back members at the peripheral edges of the front and back members. The coupled front and back members cooperate to form a hand receiving portion which includes a thumb stall and a plurality of finger stalls.

The hockey glove of the present invention includes a wrist closure mechanism for securely fastening the glove to a user's hand and wrist. The wrist coupling mechanism includes a first flap attached to the back member with hook and loop type fasteners, such as Velcro®, provided on both the interior and exterior surface of the first flap. A second flap is attached to an opposite side of the back member from the first flap member. The second flap includes hook and loop type fasteners, such as Velcro® on an interior side of the second flap Finally, hook and loop type fasteners are provided on an exterior surface of a portion of the front member's palm portion which is adjacent the user's wrist. In operation, the first flap is positioned to overlap the palm portion such that the hook and loop type fasteners on the interior surface of the first flap connect with the hook and loop type fasteners on the exterior surface of the palm portion. The second flap is then positioned to overlap the first flap where the hook and loop type fastener on the interior surface of the second flap will couple with the hook and loop type fastener on the exterior surface of the first flap. This combination of elements provides a quick wrist closure mechanism and further secures the front member to the back member. Additional cooperating snaps and conventional lacing structure may also be added.

Further details and advantages of this invention will become apparent from the following description in connection with the accompanying drawings, wherein like reference numerals present like elements throughout.

DESCRIPTION OF THE PREFERRED EMBODIMENTS

Figure 3:
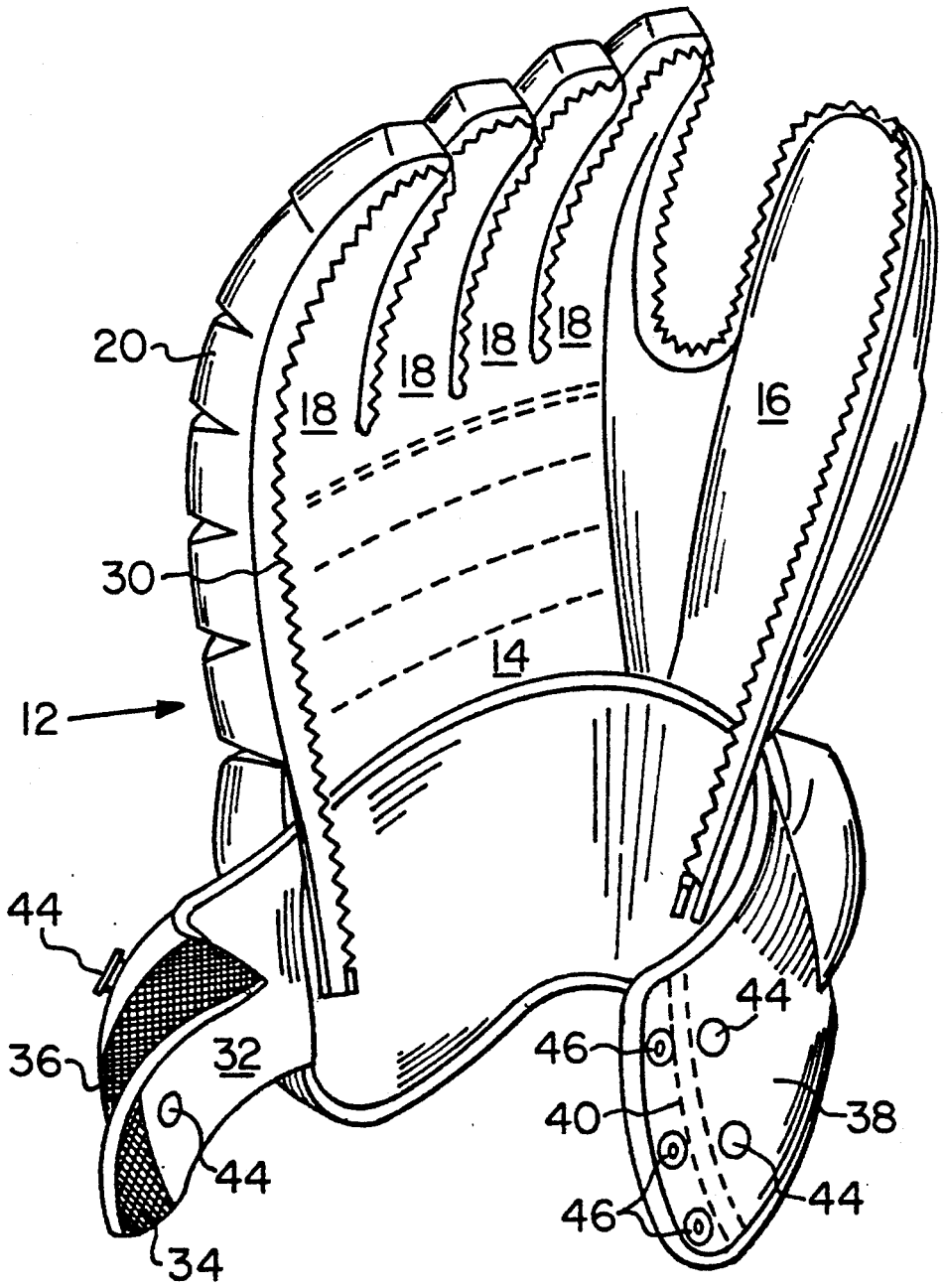
FIG. 3 is a perspective view of a back member of the present invention.

The hockey glove 10 of the present invention includes a back member 12, shown in FIG. 3, which covers the back of the user's hand. The back member includes a body portion 14, a thumb portion 16 and four finger portions 18, although it should be appreciated that the glove may be formed with less than four finger portions 18.

Padding 20 is attached to the exterior side of the back member 12 and substantially covers the exterior surface of the back member 12. The padding 20 may be in the form of foam padding inserts. The padding may be in a form of a plurality of rolls, some of which extend across the back of the hand, generally on the exterior surface of the body portion 14. Other of the rolls may be positioned longitudinally along the exterior surface of the finger portions 18. Similarly, another padding roll may be provided which corresponds to the shape of the thumb portion 16. Additionally, the padding rolls may be tapered.

Figure 2:
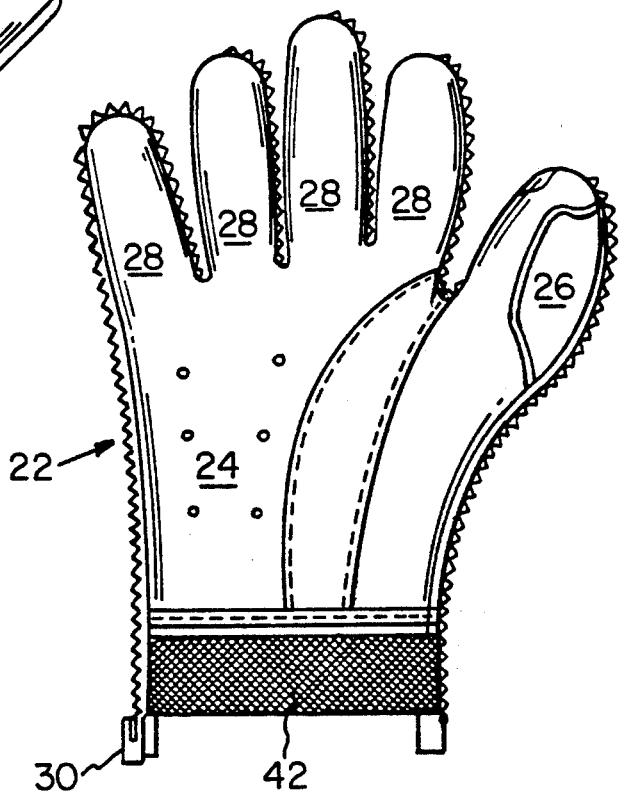
FIG. 2 is a perspective view of a front member of the hockey glove of the present invention.

A removable front member 22, shown in FIG. 2, covers the front portion of the hand. A plurality of front members 22 may be provided for use with a single back member 12. Each removable front member 22 includes a palm portion 24, a thumb portion 26 and four finger portions 28. The thumb portion is normally stitched to the remainder of the palm portion. Fewer finger portions 28 may be formed, limited only in that the number of finger portions 28 of the front member 22 are intended to correspond with the number of finger portions 18 of the back member 12. The front members 22 can be made of any thickness desired; and it is contemplated that a plurality of front members with varying thicknesses can be attached to the same back member 12. However, it is preferred that the front member 22 have a thickness of 0.8 to 0.9 mm and be formed of leather. This size and material provide an effective ice hockey glove which maintains the appropriate flexibility and control for the player. Front member 22 terminates in an end surface 42 which can be stitched to palm portion 24. The function of end surface 42 will be described hereinafter.

Figure 1:
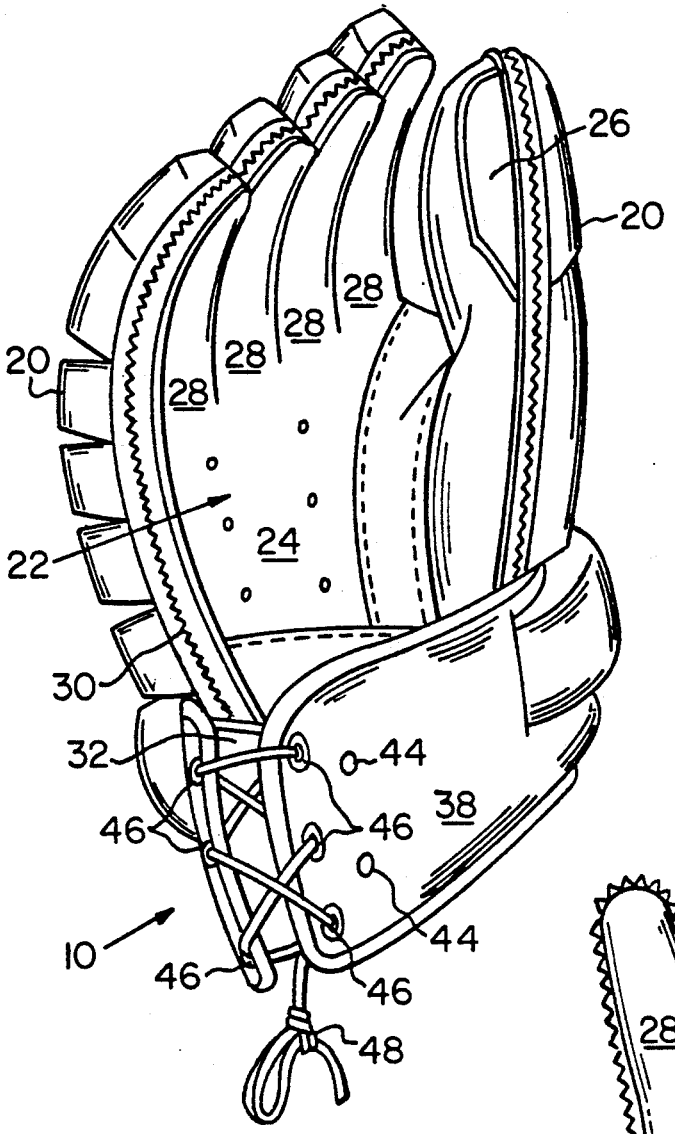
FIG. 1 is a perspective view of the ice hockey glove of the present invention as viewed from the palm side.

As shown in FIG. 1, the back member 12 and front member 22 are attached together by a zipper 30 to form a hand receiver portion which includes a thumb stall and a plurality of finger stalls. Zipper 30 extends along the peripheral side edges of the body portion 14 and the peripheral side edges of the palm portion 24. Additionally, the zipper 30 extends along the peripheral edges of the thumb 16, 26 and finger portions 18, 28 of the front member 22 and the back member 12. The zipper 30 is preferably a thin, narrow, soft zipper with a lock, thereby allowing the zipper 30 to effectively operate on the peripheral edges in the spaces between the finger stalls.

The hockey glove 10 of the present invention includes a wrist closure mechanism for securely fastening the glove to the user's hand and wrist. The wrist closure mechanism includes a first flap 32 attached to one side of the body portion 14. Hook and loop type fasteners, such as Velcro ®, are provided on both the interior and the exterior surface of the flap 32, shown as 34 and 36 respectively in FIG. 3. A second flap 38 is attached to the body portion 14 on an opposite side of the body portion 14 from the first flap 32. The second flap includes a hook and loop type fastener 40 (shown in phantom in FIG. 3), such as Velcro ®, positioned on an interior surface of the second flap 38. A hook and loop type fastener end surface 42 (shown in FIG. 2), such as Velcro ®, is provided on an exterior surface of the palm portion 24 and is positioned adjacent the user's wrist Cooperating snaps 44 are provided on the first flap 32 and the second flap 38. Additionally, lacing holes 46 are provided on the exterior portions of the first flap 32 and a side of the body portion 14.

In operation, the wrist closure mechanism operates as follows. With the user's hand in the ice hockey glove 10, the first flap is secured against the user's wrist by securing the Velcro ® portion 34 to the Velcro ® portion 42. The second flap 38 is secured to the first flap by coupling Velcro ® portion 42 to Velcro ® portion 36. The flaps are additionally secured to another by coupling cooperating snaps 44. Finally, the ice hockey glove 10 is tightened and fastened by lacing the lacing holes 46 with a lace or tie 48 (shown in FIG. 1).

The zipper 30 allows for quick and easy replacement of the front member 22. The zipper 30 is positioned in a location so that it does not interfere with the operation of the ice hockey glove 10. The zipper 30 extends substantially around the periphery of the hand receiving portion so as to form a substantially closed glove. The present invention allows the ice hockey glove to include a single back member 12 and a plurality of front members 22, thereby extending the life and usefulness of the ice hockey glove 10.

Having described the presently preferred embodiments of the present invention, it will be understood that various modifications may be made to the present invention without departing from the spirit and scope thereof. The scope of the present invention is limited only by the scope of the following claims.

I claim:

1. A hockey glove comprising:

a back member including a body portion, a thumb portion and a plurality of finger portions;

padding means attached to an exterior side of said back member substantially covering said back member;

a removable front member including a palm portion, a thumb portion and a plurality of finger portions;

an attaching means for removably coupling said front member to said back member at peripheral edges of said front member and said back member, whereby said front and back members cooperate to form a hand receiving portion including a thumb stall and a plurality of finger stalls; and a wrist closure means for securely fastening said glove to a user's hand and wrist, said wrist closure means including a first flap attached to a first side of said back member with fastening means provided on both the interior and exterior surfaces of said first flap, a second flap attached to a second side of said back member opposed from said first side of said back member, with fastening means provided on the interior of said second flap, and fastening means provided on an exterior surface of a terminal part of said front member's palm portion.

2. The glove of claim 1 wherein coupling snaps are provided on said first and second flaps for connecting said first and second flaps together.

3. The glove of claim 1 wherein a plurality of lacing holes are provided on said second flap and said body portion.

4. The glove of claim 1 wherein said attaching means extends along peripheral side edges of said back member body portion and said front member palm portion, and extends along peripheral edges of said thumb and finger portions of said front and back members.

5. The glove of claim 4 wherein said attachment means is a zipper.

6. The glove of claim 1 wherein said attachment means is a zipper.

7. The glove of claim 1 wherein said attaching means has a first end on said first side of said back portion and a second end on said second side of said back portion.

8. The glove claim 1 wherein said fastening means of said first and second flaps and said palm portion include hook and loop type fasteners.

9. A hockey glove comprising:

a black member including a body portion, a thumb portion and a plurality of finger portions;

padding means attached to an exterior side of said back member substantially covering said back member;

a removable front member selected form a plurality of said removable front members, each said front member including a palm portion, a thumb portion and a plurality of finger portions;

attaching means for removably coupling said back member to one of said front member at peripheral edges of said front member and said back member, whereby said front and back members cooperate to form a hand receiving portion including a thumb stall and a plurality of finger stalls; and a wrist closure means for securely fastening said glove to a user, said wrist closure means including a first flap attached to a first side of said back member with fastening means provided on both the interior and exterior surfaces of said first flap, a second flap attached to a second side of said back member opposed from said first side of said back member, with fastening means provided on the interior of said second flap, and fastening means provided on an exterior surface of a part of said back member's palm portion which is adjacent the user's wrist.

10. The glove of claim 9 wherein said attaching means extends along peripheral side edges of said back member body portion and said front member palm portion, and extends along peripheral edges of said thumb and finger portions of said front and back members.

11. The glove of claim 9 wherein said attaching means has a first end on said first side of said back portion and a second end on said second side of said back portion.

12. The glove of claim 9 wherein said fastening means of said first and second flaps and said palm portion include hook and loop type fasteners.

13. A hockey glove comprising:

a back member including a body portion having opposed side edges thereof, a thumb portion and a plurality of finger portions;

padding means attached to an exterior side of said back member substantially covering said back member;

a removable front member selected from a plurality of said removable front members, each said front member including a palm portion, a thumb portion and a plurality of finger portions;

a zipper removably coupled said back member to one of said plurality of front members at peripheral edges of said front member and said back member, whereby said front and back members cooperate to form a hand receiving portion including a thumb stall and a plurality of finger stalls, wherein said zipper extends form a first end on one said side edge of said body portion adjacent the user's wrist to a second end on an opposed side edge of said body portion adjacent the user's wrist; and a wrist closure means for securely fastening the glove to the user, said wrist closure means including a first flap attached to said back member along said side edge of said body member with hook and loop type fasteners provided on both the interior and exterior surfaces of said first flap, a second flap attached to said back member at an opposed side edge of said body member from said first flap, with hook and loop type fasteners provided on the interior of said second flap, and hook and loop type fasteners provided on an exterior surface of said back member's palm portion which is adjacent the user's wrist.

14. The glove of claim 13 wherein coupling snaps are provided on said first and said second flaps for coupling said flaps together, and wherein a plurality of lacing holes is provided on said second flap and said body portion for coupling said second flap to said body portion.

* * * * *